US009201337B2

(12) United States Patent
Tagawa et al.

(10) Patent No.: US 9,201,337 B2
(45) Date of Patent: Dec. 1, 2015

(54) DEVELOPING ROLLER

(75) Inventors: Hirotaka Tagawa, Yokohama (JP); Takayuki Sugimura, Yokohama (JP)

(73) Assignee: BRIDGESTONE CORPORATION, Tokyo (JP)

( * ) Notice: Subject to any disclaimer, the term of this patent is extended or adjusted under 35 U.S.C. 154(b) by 48 days.

(21) Appl. No.: 14/130,068

(22) PCT Filed: Jul. 5, 2012

(86) PCT No.: PCT/JP2012/067215

§ 371 (c)(1),
(2), (4) Date: Dec. 30, 2013

(87) PCT Pub. No.: WO2013/005803

PCT Pub. Date: Jan. 10, 2013

(65) Prior Publication Data

US 2014/0126935 A1 May 8, 2014

(30) Foreign Application Priority Data

Jul. 5, 2011 (JP) ..... 2011-149135

(51) Int. Cl.
*G03G 15/08* (2006.01)

(52) U.S. Cl.
CPC ..... *G03G 15/0818* (2013.01); *G03G 15/0806* (2013.01); *G03G 15/0808* (2013.01)

(58) Field of Classification Search
CPC ..... G03G 15/0808; G03G 15/0818; G03G 15/0806
USPC ..... 399/286
See application file for complete search history.

(56) References Cited

U.S. PATENT DOCUMENTS

| | | | | |
|---|---|---|---|---|
| 6,287,246 | B1 | 9/2001 | Yoshii et al. | |
| 6,922,542 | B2 | 7/2005 | Mizuno et al. | |
| 2002/0114649 | A1 | 8/2002 | Ohuchi | |
| 2007/0111874 | A1* | 5/2007 | Sugimura et al. | 492/59 |
| 2008/0292366 | A1* | 11/2008 | Akama et al. | 399/286 |
| 2008/0304874 | A1 | 12/2008 | Takagi et al. | |
| 2012/0129666 | A1* | 5/2012 | Egashira et al. | 492/18 |

FOREIGN PATENT DOCUMENTS

| | | | |
|---|---|---|---|
| JP | 2000-154228 | A | 6/2000 |
| JP | 2000-338773 | A | 12/2000 |
| JP | 2003-215921 | A | 7/2003 |
| WO | 02/056119 | A1 | 7/2002 |
| WO | WO 2010021402 | * | 2/2010 |

OTHER PUBLICATIONS

International Search Report for PCT/JP2012/067215 dated Aug. 7, 2012.
Extended European Search Report issued Jan. 27, 2015 in corresponding European Patent Application No. 12807689.0.

* cited by examiner

*Primary Examiner* — Joseph S Wong
(74) *Attorney, Agent, or Firm* — Sughrue Mion, PLLC

(57) ABSTRACT

A developing roller in which the decay rate of the surface potential is high and in which an image failure caused by the accumulation of electric charge does not occur is provided. The developing roller 10 includes a shaft 1, an elastic layer 2 supported on the outer periphery of the shaft, and at least one coating layer 3, 4 formed on the outer periphery of the elastic layer. The volume resistivity of a layer on the inner periphery side of the elastic layer and the coating layer is smaller than the volume resistivity of a layer on the outer periphery side, and the difference between the volume resistivities of the elastic layer and the coating layer positioned on the outermost periphery side is in the range of 2.8 to 4.3 (Log Ωcm).

12 Claims, 2 Drawing Sheets

(a)

(b)

DEVELOPING ROLLER

CROSS REFERENCE TO RELATED APPLICATIONS

This application is a National Stage of International Application No. PCT/JP2012/067215 filed Jul. 5, 2012, claiming priority based on Japanese Patent Application No. 2011-149135 filed Jul. 5, 2011, the contents of all of which are incorporated herein by reference in their entirety.

TECHNICAL FIELD

The present invention relates to a developing roller (hereinafter, also simply referred to as "roller"), and more specifically to a developing roller which is used in an image forming apparatus such as an electrophotographic apparatus or an electrostatic recording apparatus, for example, a copying machine or a printer.

BACKGROUND ART

In recent years, with the development of electrophotographic technology, there is also an increasing need for an electrically conductive member used in each electrophotographic process. Among others, it is required that a developing roller used in a developing process have not only a predetermined electric resistance value but also a variety of characteristics corresponding to a development mechanism.

Conventionally, as a development method in which a non-magnetic mono component developer is used as a developer (toner), known is a development method (impression development) in which a toner is provided via a developing roller on an image holding body such as a photoconductor drum on which an electrostatic latent image is held, and the toner is attached to the latent image on the image holding body, thereby visualizing the latent image. By this method, since a magnetic material is not needed, simplification and miniaturization of an apparatus becomes easy, as well as colorization of toner becomes easy. Since, in this development method, development is performed by adhering a toner on the latent image on the image holding body by contacting the developing roller on which a toner is held on an image holding body which holds an electrostatic latent image, the developing roller used for the development method needs to be formed of an elastic body having electrical conductivity.

FIG. 2 illustrates one example of the structure of a development apparatus using impression development. In the illustrated development apparatus, a developing roller 10 is arranged between a toner supplying roller 11 which supplies toner and a photoconductor drum 12 which holds an electrostatic latent image in a state in which the developing roller 10 is in contact with the photoconductor drum 12. Each of these rollers, the developing roller 10, the photoconductor drum 12 and the toner supplying roller 11 rotates in the arrow direction in the figure, and toner 13 is supplied on the surface of the developing roller 10 by the toner supplying roller 11. The supplied toner is adjusted in an uniform thin layer by a layer forming blade 14. The developing roller 10 in this state rotates while being in contact with the photoconductor drum 12, and thus the toner formed in a thin layer adheres to the latent image on the photoconductor drum 12 from the developing roller 10, whereby the latent image is visualized. Reference numeral 15 in the figure indicates a transfer unit, where a toner image is transferred to recording media such as a paper. Reference numeral 16 indicates a cleaning unit, by which toner remaining on the surface of the photoconductor drum 12 after the image is transferred is removed by a cleaning blade 17. In addition, reference numeral 18 indicates a charge roller which is in contact with the photoconductor drum 12 and which electrifies the photoconductor drum 12.

In this case, the developing roller 10 needs to rotate while surely maintaining a state in which the developing roller 10 is in close contact with the photoconductor drum 12; therefore, normally, those which have a basic structure in which an elastic layer composed of an electrically conductive rubber, high-molecular-weight elastomer, high-molecular-weight foam, or the like to which electrical conductivity is imparted by adding thereto a conductive agent has been formed on the outer periphery of a shaft composed of a material having a good electrical conductivity such as a metal, and which have, on the outer periphery of the basic structure, one or more coating layers in order to obtain a desired surface roughness, electrical conductivity, hardness or the like, are used.

As an improvement technique relating to such a developing roller, for example, Patent Document 1 discloses a method of examining a toner support in which, for a toner support composed of a shaft having an excellent electrical conductivity and a semiconducting layer formed on the outer periphery thereof, when a voltage of 8 kV is applied to a corona discharger which is arranged allowing 1 mm spacing between the surface of the toner support and the corona discharger and a corona discharge is generated to electrify the surface, the absolute value of the decay rate of the surface potential 0.1 second to 0.2 seconds after applying an electric charge is examined. Patent Document 2 discloses a technique of adjusting the relative permittivity, the surface resistance, and the volume resistance of an intermediate transfer belt used for forming an image such that the potential which is charged in the first primary transfer decays to ⅓ of the transfer potential or lower by the time when the belt comes to the position of the next primary transfer.

RELATED ART DOCUMENTS

Patent Documents

Patent Document 1: Japanese Unexamined Patent Application Publication No. 2003-215921 (claims and the like)

Patent Document 2: Domestic re-publication of PCT international application No. 2002-56119 (claims and the like)

SUMMARY OF THE INVENTION

Problems to be Solved by the Invention

By the way, in a developing roller, an electric charge may accumulate on the surface of the roller due to a continuous use. By this, toner migrates from the surface of the roller to a photoconductor drum more than needed, thereby causing a failure with a printed image such as ghost, fog, or deterioration of tone, which is problematic. These are due to slow decay of the surface potential. It is thought that, as illustrated in FIG. 3(*a*), the surface potential of a developing roller which is to be reduced to an initial value per one rotation under normal circumstances is not reduced sufficiently as illustrated in FIG. 3(*b*), which increases the surface potential during continuous use.

Although, as disclosed in Patent Document 2, a technique of adjusting decay of the surface potential of an intermediate transfer belt is conventionally known, a technique of controlling the surface potential of a developing roller has not been discovered. The establishment of a technique for preventing the occurrence of an image failure caused by the accumulation of electric charge by adjusting the decay rate of the surface potential of a developing roller to a desired value has been desired.

Accordingly, an object of the present invention is to overcome the above-mentioned problems and to provide a developing roller in which the decay rate of the surface potential is high and in which an image failure caused by the accumulation of electric charge does not occur.

Means for Solving the Problems

The present inventors intensively studied to discover that the above-mentioned problems can be resolved by defining, in a developing roller comprising at least two layers, an elastic layer and a coating layer, the volume resistivities of the layers in a predetermined relationship and by defining the difference between the volume resistivities of an elastic layer on the inner periphery side and a layer positioned on the outermost periphery side in a predetermined range, thereby completing the present invention.

In other words, the present invention is a developing roller comprising a shaft, an elastic layer supported on the outer periphery of the shaft, and at least one coating layer formed on the outer periphery of the elastic layer, characterized in that the volume resistivity of a layer on the inner periphery side of the elastic layer and the coating layer is smaller than the volume resistivity of a layer on the outer periphery side, and in that the difference between the volume resistivities of the elastic layer and the coating layer positioned on the outermost periphery side is in the range of 2.8 to 4.3 (Log Ωcm).

In the present invention, each of the elastic layer and the coating layer preferably contains electrically conductive carbon and aliphatic quaternary ammonium sulfate. In this case, the elastic layer suitably contains 0.5 to 3 parts by mass of the electrically conductive carbon and 0.2 to 3 parts by mass of the aliphatic quaternary ammonium sulfate with respect to 100 parts by mass of a resin component. In the present invention, the coating layer may be composed of two layers, a middle layer coating layer and a surface layer coating layer which are layered successively from the inner periphery side of the roller. In this case, the middle layer coating layer suitably contains 0.5 to 3 parts by mass of the electrically conductive carbon and 0.1 to 3 parts by mass of the aliphatic quaternary ammonium sulfate with respect to 100 parts by mass of the resin component. The surface layer coating layer suitably contains 0.5 to 3 parts by mass of the electrically conductive carbon and 0.1 to 3 parts by mass of the aliphatic quaternary ammonium sulfate with respect to 100 parts by mass of the resin component. Further, in the present invention, preferably, the surface layer coating layer contains an organic complex lithium salt. More preferably, the surface layer coating layer contains 0.1 to 3 parts by mass of the organic complex lithium salt with respect to 100 parts by mass of the resin component.

Effects of the Invention

According to the present invention, by employing the above-mentioned constitution, it becomes possible to attain a developing roller in which the decay rate of the surface potential is high and in which an image failure caused by the accumulation of electric charge does not occur.

MODE FOR CARRYING OUT THE INVENTION

Embodiments of the present invention will now be described in detail with reference to the Drawings.

Figure 1:
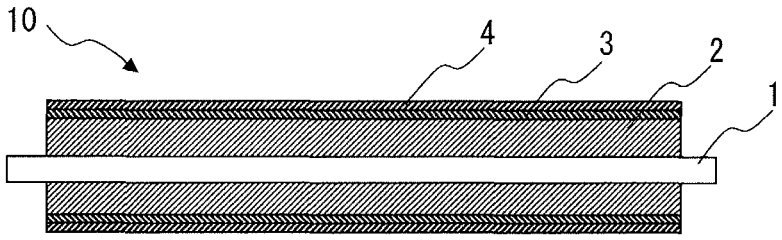
FIG. 1 is a cross-sectional view in a longitudinal direction illustrating one example of a developing roller of the present invention.
Figure 2:
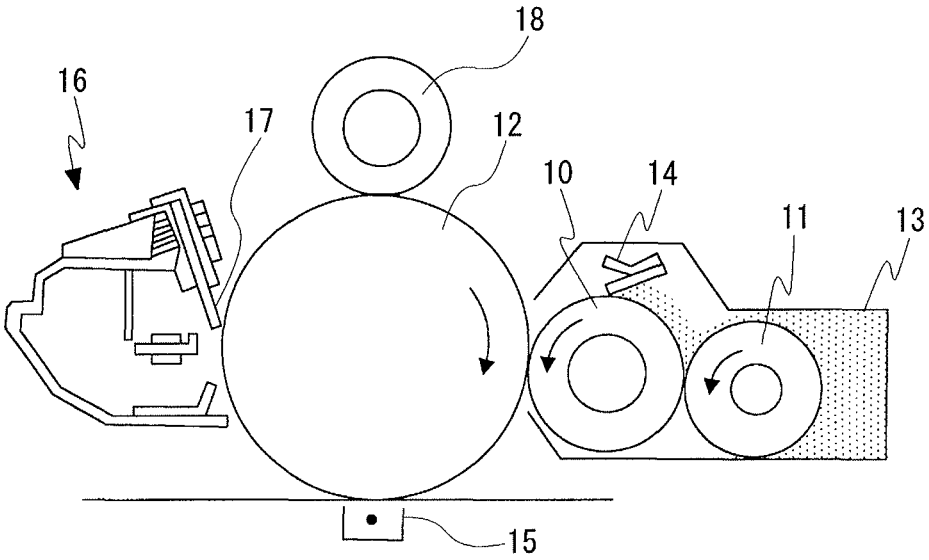
FIG. 2 is a schematic view illustrating one constitution example of a development apparatus using impression development.
Figure 3:
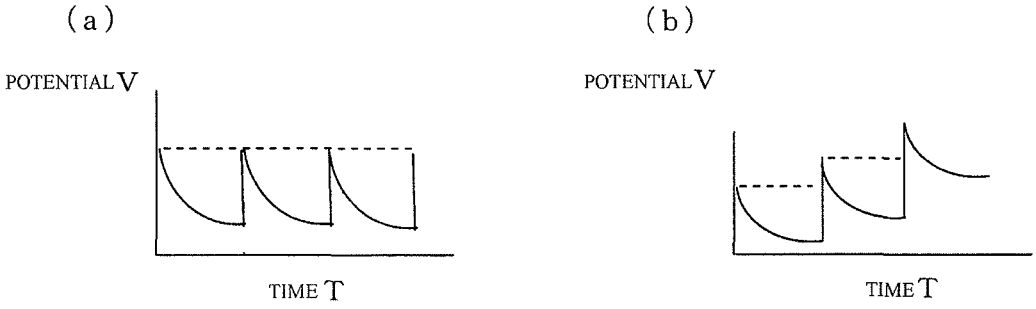
FIG. 3 is explanatory diagrams illustrating the change of the surface potential over time in the case of (a) high decay speed of the surface potential and in the case of (b) slow decay speed of the surface potential.

FIG. 1 is a cross-sectional view in a longitudinal direction illustrating one example of a developing roller of the present invention. As illustrated in FIG. 1, a developing roller 10 of the present invention comprises a shaft 1, an elastic layer 2 supported on the outer periphery of the shaft, and at least one coating layer, in the illustrated example, two coating layers composed of a middle layer coating layer 3 and a surface layer coating layer 4, formed on the outer periphery of the elastic layer 2.

In the present invention, it is important that the volume resistivity of a layer on the inner periphery side of the elastic layer 2 and the coating layer 3, 4 is smaller than the volume resistivity of a layer on the outer periphery side. Specifically, in the illustrated example, the relationship:

the volume resistivity of the elastic layer 2<the volume resistivity of the middle layer coating layer 3<the volume resistivity of the surface layer coating layer 4 is satisfied. Also in cases where the coating layer is composed of three or more layers, in a similar manner to the above, the relationship:

the volume resistivity of the coating layer positioned on the outermost periphery side (the surface of the roller)>the volume resistivity of the second layer from the outer periphery side>the volume resistivity of the third layer from the outer periphery side . . . , is satisfied.

In the present invention, it is also important that the difference between the volume resistivities of the elastic layer 2 and a coating layer positioned on the outermost periphery side, in the illustrated example, the surface layer coating layer 4, is in the range of 2.8 to 4.3 (Log Ωcm). In the present invention, the volume resistivity of a layer on the inner periphery side of the elastic layer and the coating layer is smaller than the volume resistivity of a layer on the outer periphery side, and the difference between the volume resistivities of the elastic layer and the coating layer positioned on the outermost periphery side is in the range of 2.8 to 4.3 (Log Ωcm), thereby attaining a developing roller in which the decay rate of the surface potential is high. Therefore, in the developing roller of the present invention, the accumulation of electric charge on the surface of the roller during continuous use can be prevented, and an image failure such as a ghost, fog, or deterioration of tone caused by the accumulation is not generated.

In the case in which the difference between the volume resistivities of the elastic layer and a layer of the coating layer positioned on the outermost periphery side is less than 2.8 (Log Ωm), electrification of the toner becomes insufficient and the density of a printed image becomes low. In the case in which the difference is higher than 4.3 (Log Ωcm), electrification of the toner becomes excessive and toner migrates from the surface of the roller to a photoconductor drum more than needed, thereby causing a failure with a printed image such as fog. In both cases, a desired effect of the present invention is not obtained.

Here, in the developing roller of the present invention, setting a time for the initial surface potential decreasing by 1/e to the relaxation time (τ), the τ is preferably 0.45 s or shorter. When the τ is longer than 0.45 s, the accumulation of electric charge on the surface of the roller can not be sufficiently controlled, which may cause image failure during continuous use.

In the developing roller of the present invention, by satisfying conditions relating to the magnitude relationship of the volume resistivities of the above-mentioned layers and the difference of the volume resistivities, a desired effect of the present invention can be obtained. Other specifications such as the constitution or the constituent materials of the roller can be appropriately selected according to a usual manner and not particularly restricted.

The shaft 1 is not limited and any shaft may be used as long as it has an excellent electrical conductivity. Examples thereof which may be used include: one obtained by coating a steel material such as a sulfur free-cutting steel with nickel, zinc or the like; a cored bar constituted by a solid body made of a metal such as iron, stainless steel or aluminum; and a metal shaft such as a metal cylindrical body whose inside is hollowed.

The elastic layer 2 can be formed by rubber or resin, or a foam (foam) thereof depending on the application of the roller. Specific examples of the foam include a rubber composition using, as a base rubber, polyurethane, silicone rubber, butadiene rubber, isoprene rubber, chloroprene rubber, styrene-butadiene rubber, ethylene-propylene rubber, polynorbornene rubber, styrene-butadiene-styrene rubber, epichlorohydrin rubber, or the like, and a foam thereof.

Among others, in the present invention, polyurethane foam is preferably used. A raw material for forming such a polyurethane foam is not particularly restricted as long as a urethane bond is contained in the resin.

Examples of the polyol component which can be used include: polyether polyols made by addition polymerization of ethylene oxide and propylene oxide; polytetramethylene ether glycol; polyesther polyol made by condensing an acid ingredient and a glycol ingredient; polyester polyol made by ring-open polymerization of caprolactone; and polycarbonate diols.

Examples of the polyether polyol which is made by addition polymerization of ethylene oxide and propylene oxide include a polyether polyol which is made by addition polymerization of ethylene oxide and propylene oxide by using, as a starting material, for example, water, propylene glycol, ethylene glycol, glycerin, trimethylol propane, hexane triol, triethanol amine, diglycerine, pentaerythritol, ethylene diamine, methyl glucoside, aromatic diamine, sorbitol, sucrose or phosphoric acid. A polyether polyol which is made by using, as a starting material, water, propylene glycol, ethylene glycol, glycerin, trimethylol propane or hexane triol is particularly preferred. Regarding the percentage of ethylene oxide and propylene oxide to be added and the microstructures of the polyether polyol, those in which the percentage of ethylene oxide is preferably 2 to 95% by mass, and more preferably 5 to 90% by mass, and in which a polyether polyol which has etheylene oxide at a terminal thereof are preferred. The sequence of ethylene oxide and propylene oxide in the molecular chain is preferably random.

Regarding the molecular weight of the polyether polyol, when water, propylene glycol or ethylene glycol is used as a starting material, the polyether polyol is bifunctional, and the molecular weight is preferably in the range of 300 to 6000 in terms of weight-average molecular weight, and more preferably in the range of 400 to 3000. When glycerin, trimethylol propane or hexane triol is used as a starting material, the polyether polyol is trifunctional, and the molecular weight is preferably in the range of 900 to 9000 in terms of weight-average molecular weight, and more preferably in the range of 1500 to 6000. Further, bifunctional polyol and trifunctional polyol may be used by blending them appropriately.

Polytetramethylene ether glycol may be obtained, for example, by cationic polymerization of tetrahydrofuran. Polytetramethylene ether glycol having a weight-average molecular weight in the range of 400 to 4000, and particularly in the range of 650 to 3000 is preferably employed. Polytetramethylene ether glycols having different molecular weights are preferably blended. Further, a polytetramethylene ether glycol obtained by copolymerization of alkylene oxide(s) such as ethylene oxide and/or propylene oxide may also be employed.

Further, polytetramethylene ether glycol and polyether polyol made by addition polymerization of ethylene oxide and propylene oxide are preferably blended to be used. In this case, the blend ratio thereof is suitably in the range of 95:5 to 20:80 in terms of weight ratio, and particularly, in the range of 90:10 to 50:50.

The above-mentioned polyol component may be used in combination with polyols such as a polymer polyol which is acrylonitrile modified polyol, a polyol to which melamine is added, diols such as butanediol, trimethylol propane or derivatives thereof.

As the polyisocyanate ingredient, aromatic isocyanate or derivatives thereof, aliphatic isocyanate or derivatives thereof, or cycloaliphatic isocyanate or derivatives thereof is used. Among these, aromatic isocyanate or derivatives thereof is preferred, and particularly, tolylene diisocyanate (TDI) or derivatives thereof, diphenylmethane diisocyanate (MDI) or derivatives thereof is preferably used.

As the tolylene diisocyanate or derivatives thereof, crude tolylene diisocyanate, 2,4-tolylene diisocyanate, 2,6-tolylene diisocyanate, a mixture of 2,4-tolylene diisocyanate and 2,6-tolylene diisocyanate, urea modified product thereof, biuret modified product thereof, carbodiimide modified product thereof or urethane modified product modified by, for example, polyol is used. As the diphenylmethane diisocyanate or derivatives thereof, for example, a diphenylmethane diisocyanate or derivatives thereof obtained by phosgenating diamino diphenyl methane or derivatives thereof is used. Examples of the derivatives of diamino diphenyl methane include a polynuclear one, and pure diphenyl methane diisocyanate obtained by diamino diphenyl methane, polymeric diphenylmethane diisocyanate obtained by polynuclear diaminodiphenylmethane, or the like may be used. With respect to the number of functionalities of polymeric diphenylmethane diisocyanate, a mixture of pure diphenylmethane diisocyanate and polymeric diphenylmethane diisocyanates having a variety of numbers of functionalities is usually used, and those having an average number of functionalities of preferably 2.05 to 4.00, and more preferably 2.50 to 3.50 are used. Derivatives obtained by modifying these diphenylmethane diisocyanates or derivatives thereof such as urethane modified product modified by, for example, polyol, a dimer made by uretdione formation, isocyanurate modified product, carbodiimide/uretonimine modified product, allophanate modified product, urea modified product, biuret modified product may also be used. Also, several kinds of diphenylmethane diisocyanates or derivatives thereof may be blended to be used.

The isocyanate may be prepolymerized in advance with a polyol, and examples of its method include a method wherein a polyol and an isocyanate are placed in an appropriate container, and the mixture is stirred sufficiently, followed by incubation thereof at 30 to 90° C., more preferably at 40 to 70° C., for 6 to 240 hours, more preferably for 24 to 72 hours. In this case, the ratio of the amounts of the polyol and the isocyanate is adjusted such that the content of the isocyanate in the obtained prepolymer becomes preferably 4 to 30% by mass, more preferably 6 to 15% by mass. In cases where the content of the isocyanate is less than 4% by mass, the stability of the prepolymer is deteriorated and the prepolymer is cured during storage, so that the prepolymer may not be usable. In cases where the content of the isocyanate is higher than 30% by mass, the content of the isocyanate which is not prepolymerized increases, and this polyisocyanate is cured with a polyol component used in the later polyurethane curing reaction by a reaction mechanism similar to the one-shot method wherein a prepolymerization reaction is not involved, so that the effect by using the prepolymer method decreases. In cases where the isocyanate component to be used is prepared by prepolymerization in advance of isocyanate with a polyol, examples of the polyol component which may be used include, in addition to the above-described polyol compounds, diols such as ethylene glycol and butanediol, polyols such as trimethylolpropane and sorbitol, and derivatives thereof.

In addition to these polyol components and isocyanate components, electrically conductive agents, foaming agents (water, low-boiling materials, gaseous materials and the like), cross-linking agents, surfactants, catalysts, foam stabilizers and the like may be added to the raw material of the polyurethane foam, to prepare a desired elastic layer.

For the electrically conductive agent, two types of components, an electrically conductive carbon such as Ketjen Black and acetylene black, or aliphatic quaternary ammonium sulfate are preferably used in combination. The compounding ratio is not particularly restricted, and appropriately selected as needed. For example, with respect to 100 parts by mass of a resin component which constitutes an elastic layer, electrically conductive carbon in an amount of 0.5 to 3 parts by mass and aliphatic quaternary ammonium sulfate in an amount of 0.2 to 3 parts by mass are preferably mixed.

Examples of the catalyst used for the curing reaction of the polyurethane foam include monoamines such as triethylamine and dimethylcyclohexylamine; diamines such as tetramethylethylenediamine, tetramethylpropanediamine and tetramethylhexanediamine; triamines such as pentamethyldiethylenetriamine, pentamethyldipropylenetriamine and tetramethylguanidine; cyclic amines such as triethylenediamine, dimethylpiperazine, methylethylpiperazine, methylmorpholine, dimethylaminoethylmorpholine and dimethylimidazole; alcohol amines such as dimethylaminoethanol, dimethylaminoethoxyethanol, trimethylaminoethylethanolamine, methylhydroxyethylpiperazine and hydroxyethylmorpholine; ether amines such as bis (dimethylaminoethyl)ether and ethylene glycol bis (dimethyl)aminopropyl ether; organic metal compounds such as stannous octoate, dibutyltin diacetate, dibutyltin dilaurate, dibutyltin mercaptide, dibutyltin thiocarboxylate, dibutyltin dimaleate, dioctyltin mercaptide, dioctyltin thiocarboxylate, phenylmercuric propionate and lead octenoate. These catalysts may be used individually or two or more types thereof may be used in combination.

In the present invention, a silicone foam stabilizer and various types of surfactants are preferably mixed in the polyurethane foam mixture in order to stabilize cells of the foam material. Examples of the silicone foam stabilizer which are preferably used include dimethylpolysiloxane-polyoxyalkylene copolymers, and those comprising the dimethylpolysiloxane moiety having a molecular weight of 350 to 15,000 and the polyoxyalkylene moiety having a molecular weight of 200 to 4,000 are especially preferred. The molecular structure of the polyoxyalkylene moiety is preferably an addition polymer of ethylene oxide or an addition copolymer of ethylene oxide and propylene oxide, and its molecular ends are also preferably ethylene oxide. Examples of the surfactant include ionic surfactants such as cationic surfactants, anionic surfactants and ampholytic surfactants; and nonionic surfactants such as various types of polyethers and various types of polyesters. These may be used individually or two or more types thereof may be used in combination. The content of the silicone foam stabilizer and the various types of surfactants is preferably 0.1 to 10 parts by mass, more preferably 0.5 to 5 parts by mass, with respect to 100 parts by mass of the total amount of the polyol component and the isocyanate component.

As the method for foaming of the raw material of the polyurethane foam of the present invention, methods such as mechanical frothing, water frothing and foaming agent-frothing, which have been conventionally used, may be used, and especially, mechanical frothing by mechanical stirring while mixing an inert gas in the raw material is preferably used. Here, the inert gas used in the mechanical frothing may be a gas which is inert in the polyurethane reaction, and examples thereof include inert gases in the narrow sense such as helium, argon, xenon, radon and krypton; and gases which are not reactive with the raw material of the polyurethane foam, such as nitrogen, carbon dioxide and dry air. In the present invention, conditions of forming an elastic layer composed of such raw materials are not particularly restricted, and the elastic layer may be formed according to usual conditions.

In order to adjust the physical property of a roller, at least one coating layer needs to be provided on an elastic layer 2, and suitably two or more, more suitably two to three coating layers can be provided on the elastic layer 2. Specifically, as illustrated, two layers, a middle layer coating layer 3 and a surface layer coating layer 4 can be provided on the elastic layer 2 successively. In cases where three or more coating layers are provided, two or more middle layer coating layers may be provided.

In the present invention, the coating layer can be formed by a variety of solvent-type paints such as urethane-based, acryl-based, acrylurethane-based, or fluorine-based paint. In particular, for the surface layer coating layer which constitutes the surface of the roller, the surface roughness can be adjusted by containing a fine particle composed of urethane, acryl, silica, or the like. Also the coating layer can have a desired electrical conductivity by appropriately containing the above-mentioned ionic conductive agent or electron conducting agent as a conductive agent, and as needed, vulcanizing agent, vulcanization accelerator, antioxidant, or the like can be appropriately added. The above-mentioned coating layer can be formed on an elastic layer 2 by coating a predetermined solvent-type paints using a known method such as dip coating, spray coating or roll coater coating, by drying, and as needed, by thermal curing.

In the present invention, for each coating layer in addition to the above-mentioned elastic layer 2, two types of conductive agents, an electrically conductive carbon and an aliphatic quaternary ammonium sulfate, are preferably contained. By this, since change in the volume resistivities of the layers during endurance becomes small, change in the decay rate of the surface potential is restricted, thereby preventing the occurrence of an image failure during endurance. The compounding ratio is not particularly restricted, and can be appropriately selected as needed. For example, to 100 parts by mass of resin components which constitute the coating layer, 0.5 to 3 parts by mass of electrically conductive carbon, and 0.1 to 3 parts by mass, in particular, 0.2 to 3 parts by mass of aliphatic quaternary ammonium sulfate are preferably added. In the present invention, the surface layer coating layer preferably contains an organic complex lithium salt. By this, an electric charge accumulated on the surface can be reduced without being influence by the temperature of humidity. The compounding ratio of the organic complex lithium salt can be, for example, 0.1 to 3 parts by mass with respect to 100 parts by mass of resin components which constitute the surface layer coating layer.

In the present invention, the thickness of the elastic layer 2 is not particularly restricted, and can be usually in a range of 1 to 7 mm. The total thickness of the middle layer coating layer can be usually in a range of 10 to 200 μm. The thickness of the surface layer coating layer can usually be in a range of 5 to 50 μm. The surface roughness of the surface layer coating layer can usually be 2 μm or smaller, in particular, in a range of 0.5 to 1.5 μm in accordance with JIS arithmetic mean roughness Ra.

In the present invention, the volume resistivity of the coating layer is preferably 7.5 (log Ωcm) or higher. When the volume resistivity of the coating layer is lower than 7.5 (log Ωcm), electrification of the toner becomes insufficient and the density of a printed image becomes low, which is not preferred. The change in the volume resistivity of each of the elastic layer and the coating layers when 100 V is applied is preferably 1.0 (log Ωcm) or smaller. When the change in the volume resistivity is larger than 1.0 (log Ωcm), the balance of the resistances of the layers is lost, adversely affecting the decay rate, which is not preferred. Further, the developing roller of the present invention is suitably one which has an initial potential of 70 to 500 V.

EXAMPLES

The present invention will now be described more concretely by way of the Examples.

Developing rollers in which an elastic layer, a middle layer coating layer and a surface layer coating layer are supported on the outer periphery of a shaft (metal shaft) as listed on Table 1 were prepared according to the combination of the formulation on the Table 4 below.

<Molding of an Elastic Layer>

100 parts by mass of prepolymerized isocyanate in which electrically conductive carbon (DENKA BLACK) was added in an amount listed on the Table below, and an ether polyol to which an ionic conductive agent in an amount listed on the Table below, 3 parts by mass of a silicone foam stabilizer and 0.1 parts by mass of a tin catalyst were added were mixed and foamed by mechanical frothing, and the foamed mixture was poured into a mold in which a metal shaft is installed. Then, this mixture was thermally cured at 110° C. for 30 minutes to form an elastic layer having a thickness of 6 mm on the outer periphery of the metal shaft. For the formed elastic layer, the volume resistivity and the increase in the resistance were measured.

Figure 4:
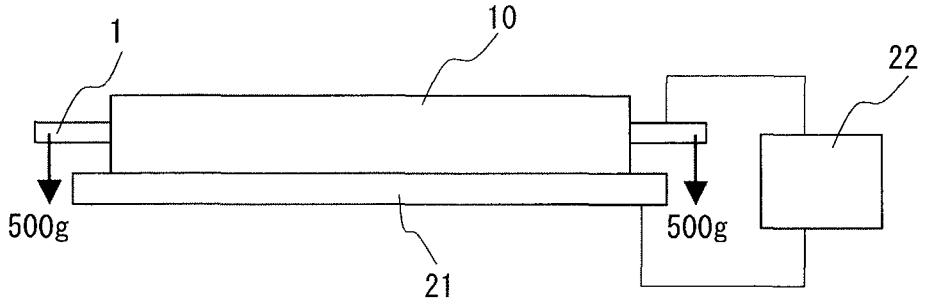
FIG. 4(*a*), (*b*) are explanatory diagrams illustrating methods of measuring increase in the resistance in the Examples.
Figure 4:
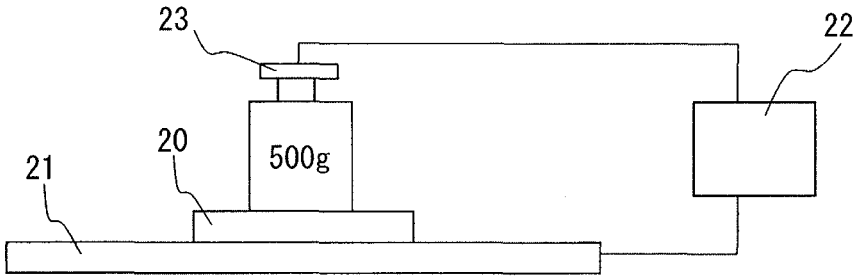

The measurement of the increase in the resistance was carried out by using Resistance Meter R8340 manufactured by ADVANTEST CORPORATION, under the condition of 23° C. 55% RH in a manner as illustrated in FIG. 4(*a*), (*b*). Specifically, a developing roller 10 is placed on a metal plate 21 as illustrated in FIG. 4(*a*), a weight of 500 g was loaded on both sides of the roller, and 100 V was applied across the metal shaft 1 and the metal plate 21, and thereafter, the resistance $R_{t=5}$ 5 seconds after the application and the resistance $R_{t=600}$ 600 seconds after the application were measured by using a resistance meter 22. A sheet 20 was placed on the metal plate 21 in a manner as illustrated in FIG. 4(*b*), a 500 g metal weight 23 was placed thereon, and 100 V was applied across the metal plate 21 and the metal weight 23, and thereafter, the resistance $R_{t=5}$ 5 seconds after the application and the resistance $R_{t=600}$ 600 seconds after the application were measured by using a resistance meter 22. Using these results, the resistance range was calculated based on the following formula:

$$\text{Change in resistance (Resistance range) log } \Omega\cdot\text{cm} = \log(R_{t=600} - R_{t=5})$$

TABLE 1

| Formulation No. | Compounding ratio (parts by mass): Electrically conductive carbon Denka black*1 | Ionic conductive agent: Elegan 264 WAX *2 | Ionic conductive agent: Perchloric acid sodium | Volume resistivity (LogΩcm) | Increase in the resistance Δ(LogΩcm) |
|---|---|---|---|---|---|
| 1-1 | 0 | 1 | — | 8.7 | 0.1 |
| 1-2 | 0.8 | 1 | — | 8.1 | 0.2 |
| 1-3 | 2 | 1 | — | 6.8 | 0 |
| 1-4 | 2 | — | 0.5 | 6.5 | 2 |

*1 Manufactured by DENKI KAGAKU KOGYO KABUSHIKI KAISHA

*2 Manufactured by NOF CORPORATION, aliphatic quaternary ammonium sulfate

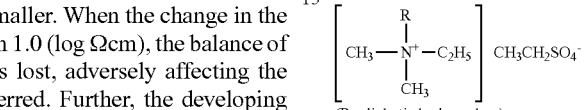

(R: aliphatic hydrocarbon)

<Formation of Middle Layer Coating Layer>

Next, 100 parts by mass of an infinite chain length urethane prepolymer (N5033 manufactured by NIPPON POLYURETHANE INDUSTRY CO., LTD.), 6 parts by mass of isocyanurated HDI, a carbon black dispersed in a solvent and an ionic conductive agent in amounts in parts listed on the Table below, and 500 parts by mass of methyl ethyl ketone (MEK) were added to prepare a paint. This paint was coated on the above-mentioned elastic layer by dipping, dried at 105° C. for 120 minutes to form a middle layer coating layer. By using this paint, a sheet of 80 mm×150 mm×0.2 mm was prepared to measure the volume resistivity and increase in the resistance of a middle layer coating layer having a thickness of 20 μm.

TABLE 2

| Formulation No. | Compounding ratio (parts by mass): Electrically conductive carbon Carbon black dispersed in MEK *3 | Ionic conductive agent: KS48 *4 | Ionic conductive agent: Perchloric acid sodium | Volume resistivity (LogΩcm) | Increase in the resistance Δ(LogΩcm) |
|---|---|---|---|---|---|
| 2-1 | 5 | 0.1 | — | 10.5 | 0.1 |
| 2-2 | 15 | 0.5 | — | 9.5 | 0.1 |
| 2-3 | 25 | 1 | — | 7.1 | 0.1 |
| 2-4 | 15 | — | 0.5 | 9.4 | 1.5 |

*3 Manufactured by Mitsubishi Chemical Corporation, carbon black MA100 dispersed in MEK (solid content concentration 20% by mass)

*4 Manufactured by Kao Corporation, aliphatic quaternary ammonium sulfate

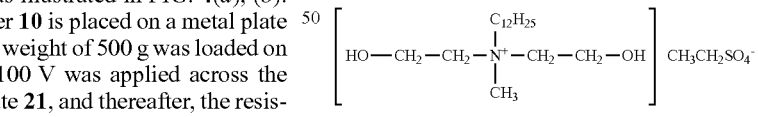

<Formation of Surface Layer Coating Layer>

Next, 100 parts by mass of polytetramethyleneglycol, 45 parts by mass of isocyanurated HDI, a carbon black dispersed in a solvent and an ionic conductive agent in amounts in parts listed on the Table below, 300 parts by mass of MEK, 15 parts by mass of silica (SS-20, manufactured by TOSOH SILICA CORPORATION), and 25 parts by mass of acrylic particle (MBX-8, manufactured by SEKISUI PLASTICS CO., Ltd.) were added to prepare a paint. This paint was coated on the above-mentioned middle layer coating layer by dipping, dried at 105° C. for 120 minutes to form a surface layer coating layer having a thickness of 20 μm. By using this paint, a sheet of 80 mm×150 mm×0.2 mm was prepared to measure the volume resistivity and increase in the resistance of the surface layer coating layer.

TABLE 3

| Formulation No. | Compounding ratio (parts by mass): Electrically conductive carbon: Carbon black dispersed in MEK*5 | Ionic conductive agent: KS48*4 | Ionic conductive agent: Perchloric acid sodium | Ionic conductive agent: PEL20BBL*6 | Volume resistivity (LogΩcm) | Increase in the resistance Δ (LogΩcm) |
|---|---|---|---|---|---|---|
| 3-1 | 3 | 0.1 | — | — | 13 | 0.1 |
| 3-2 | 7 | 0.1 | — | — | 11.4 | 0.1 |
| 3-3 | 10 | 0.5 | — | — | 9.7 | 0.1 |
| 3-4 | 12 | 1 | — | — | 7.5 | 0.1 |
| 3-5 | 10 | — | 0.5 | — | 9.6 | 1.1 |
| 3-6 | 10 | 0.5 | — | 0.5 | 9.6 | 0.1 |

*5Manufactured by Mitsubishi Chemical Corporation, carbon black MA600 dispersed in MEK (solid content concentration 20% by mass)
*6Manufactured by Japan Carlit Co., Ltd., organic complex lithium salt For each of the obtained developing rollers, by using a surface potential meter, CRT-2000 manufactured by QEA Inc., the decay behavior of the surface potential was measured. A time for the initial surface potential decreasing by 1/e was set to the relaxation time (τ).

Each obtained developing roller was incorporated in HP Color Laser Jet 4600, and image evaluation was carried out. As the result, when an abnormality of fog, ghost, or tone was not observed, the evaluation was indicated as "○", when an abnormality of fog, ghost, or tone was observed, the evaluation was indicated as "×".

The results are listed on the Table below in combination.

TABLE 4

| | Energized endurance | Formulation No.: Elastic layer | Formulation No.: Middle layer coating layer | Formulation No.: Surface layer coating layer | Volume resistivity (logΩcm): Elastic layer | Volume resistivity (logΩcm): Middle layer coating layer | Volume resistivity (logΩcm): Surface layer coating layer | Difference between volume resistivities of base/surface layer coating layer (logΩcm) | Relaxation time t | Surface potential (V) | Image quality |
|---|---|---|---|---|---|---|---|---|---|---|---|
| Comparative Example 1 | Before endurance | 1-3 | 2-1 | 3-2 | 6.8 | 10.5 | 11.4 | 4.6 | 0.48 | 121.18 | x |
| Example 1 | Before endurance | 1-1 | 2-1 | 3-1 | 8.7 | 10.5 | 13 | 4.3 | 0.38 | 115.16 | ○ |
| Example 2 | Before endurance | 1-2 | 2-1 | 3-2 | 8.1 | 10.5 | 11.4 | 3.3 | 0.39 | 85.29 | ○ |
| Example 3 | Before endurance | 1-3 | 2-2 | 3-3 | 6.8 | 9.5 | 9.7 | 2.9 | 0.40 | 120.32 | ○ |
| Comparative Example 2 | Before endurance | 1-1 | 2-1 | 3-2 | 8.7 | 10.5 | 11.4 | 2.7 | 0.6 | 228.60 | x |
| Comparative Example 3 | Before endurance | 1-3 | 2-3 | 3-4 | 6.8 | 7.1 | 7.5 | 0.7 | 0.46 | 10.34 | x |
| Comparative Example 4 | Before endurance | 1-1 | 2-3 | 3-4 | 8.7 | 7.1 | 7.5 | −1.2 | 0.46 | 176.48 | x |
| Example 4 | Before endurance | 1-3 | 2-2 | 3-6 | 6.8 | 9.5 | 9.6 | 2.8 | 0.35 | 134.52 | ○ |
| Example 5 | Before endurance | 1-3 | 2-2 | 3-3 | 6.8 | 9.5 | 9.7 | 2.9 | 0.40 | 120.32 | ○ |
| | After endurance | | | | 6.8 | 9.6 | 9.8 | 3.0 | 0.41 | 129.54 | ○ |
| Example 6 | Before endurance | 1-4 | 2-2 | 3-3 | 6.5 | 9.5 | 9.7 | 3.2 | 0.40 | 124.12 | ○ |
| | After endurance | | | | 8.5 | 9.6 | 9.8 | 1.3 | 0.54 | 99.54 | x |
| Example 7 | Before endurance | 1-3 | 2-4 | 3-3 | 6.8 | 9.4 | 9.7 | 2.9 | 0.39 | 117.51 | ○ |
| | After endurance | | | | 6.8 | 10.9 | 9.8 | 3.0 | 0.48 | 158.55 | x |
| Example 8 | Before endurance | 1-3 | 2-2 | 3-5 | 6.8 | 9.5 | 9.6 | 2.8 | 0.39 | 121.58 | ○ |
| | After endurance | | | | 6.8 | 9.6 | 10.7 | 3.9 | 0.5 | 220.54 | x |

As listed on the above Table, it was confirmed that, in each of the rollers of the Examples which satisfied the conditions of the present invention relating to the magnitude relationship of the volume resistivities of the elastic layer and coating layer and relating to the difference between the volume resistivities of the elastic layer and surface layer coating layer, the decay rate of the surface potential was high and the occurrence of an image failure due to the accumulation of electric charge was prevented compared with each of the developing rollers of the Comparative Examples which did not satisfy such conditions. By comparing Example 5 and Examples 6 to 8, it was found that, when an electrically conductive carbon and an aliphatic quaternary ammonium sulfate were added to each of the elastic layer and coating layers, the decay rate of the surface potential was not changed even after energized endurance and the occurrence of an image failure was able to be prevented.

DESCRIPTION OF SYMBOLS

1 Shaft
2 Elastic layer
3 Middle layer coating layer
4 Surface layer coating layer
10 Developing roller
20 Sheet
21 Metal plate
22 Resistance meter
23 Metal weight

The invention claimed is:

1. A developing roller comprising a shaft, an elastic layer supported on the outer periphery of the shaft, and at least one coating layer formed on the outer periphery of the elastic layer, characterized in that the volume resistivity of a layer on the inner periphery side of the elastic layer and the coating layer is smaller than the volume resistivity of a layer on the outer periphery side, and in that the difference between the volume resistivities of the elastic layer and the coating layer positioned on the outermost periphery side is in the range of 2.8 to 4.3 (Log Ωcm), wherein each of the elastic layer and the coating layer contains electrically conductive carbon and aliphatic quaternary ammonium sulfate.

2. The developing roller according to claim 1, wherein the elastic layer contains 0.5 to 3 parts by mass of the electrically conductive carbon with respect to 100 parts by mass of a resin component.

3. The developing roller according to claim 1, wherein the elastic layer contains 0.2 to 3 parts by mass of the aliphatic quaternary ammonium sulfate with respect to 100 parts by mass of a resin component.

4. The developing roller according to claim 1, wherein the coating layer is composed of two layers, a middle layer coating layer and a surface layer coating layer which are layered successively from the inner periphery side of the roller.

5. The developing roller according to claim 4, wherein the middle layer coating layer contains 0.5 to 3 parts by mass of the electrically conductive carbon with respect to 100 parts by mass of the resin component.

6. The developing roller according to claim 4, wherein the middle layer coating layer contains 0.1 to 3 parts by mass of the aliphatic quaternary ammonium sulfate with respect to 100 parts by mass of the resin component.

7. The developing roller according to claim 4, wherein the surface layer coating layer contains 0.5 to 3 parts by mass of the electrically conductive carbon with respect to 100 parts by mass of the resin component.

8. The developing roller according to claim 4, wherein the surface layer coating layer contains 0.1 to 3 parts by mass of the aliphatic quaternary ammonium sulfate with respect to 100 parts by mass of the resin component.

9. The developing roller according to claim 4, wherein the surface layer coating layer contains an organic complex lithium salt.

10. The developing roller according to claim 9, wherein the surface layer coating layer contains 0.1 to 3 parts by mass of the organic complex lithium salt with respect to 100 parts by mass of the resin component.

11. A developing roller comprising a shaft, an elastic layer supported on the outer periphery of the shaft, and at least one coating layer formed on the outer periphery of the elastic layer, characterized in that the volume resistivity of a layer on the inner periphery side of the elastic layer and the coating layer is smaller than the volume resistivity of a layer on the outer periphery side, and in that the difference between the volume resistivities of the elastic layer and the coating layer positioned on the outermost periphery side is in the range of 2.8 to 4.3 (Log Ωcm), wherein each of the elastic layer and the coating layer contains electrically conductive carbon and aliphatic quaternary ammonium sulfate, wherein the coating layer is composed of two layers, a middle layer coating layer and a surface layer coating layer which are layered successively from the inner periphery side of the roller, and wherein the middle layer coating layer contains 0.1 to 3 parts by mass of the aliphatic quaternary ammonium sulfate with respect to 100 parts by mass of the resin component.

12. A developing roller comprising a shaft, an elastic layer supported on the outer periphery of the shaft, and at least one coating layer formed on the outer periphery of the elastic layer, characterized in that the volume resistivity of a layer on the inner periphery side of the elastic layer and the coating layer is smaller than the volume resistivity of a layer on the outer periphery side, and in that the difference between the volume resistivities of the elastic layer and the coating layer positioned on the outermost periphery side is in the range of 2.8 to 4.3 (Log Ωcm), wherein each of the elastic layer and the coating layer contains electrically conductive carbon and aliphatic quaternary ammonium sulfate, wherein the coating layer is composed of two layers, a middle layer coating layer and a surface layer coating layer which are layered successively from the inner periphery side of the roller, and wherein the surface layer coating layer contains 0.1 to 3 parts by mass of the aliphatic quaternary ammonium sulfate with respect to 100 parts by mass of the resin component.

* * * * *